US006672863B2

(12) United States Patent
Doebbeling et al.

(10) Patent No.: US 6,672,863 B2
(45) Date of Patent: Jan. 6, 2004

(54) BURNER WITH EXHAUST GAS RECIRCULATION

(75) Inventors: Klaus Doebbeling, Windisch (CH); Bettina Paikert, Oberrohrdorf (CH); Christian Oliver Paschereit, Baden (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 10/145,780

(22) Filed: May 16, 2002

(65) Prior Publication Data

US 2002/0187449 A1 Dec. 12, 2002

(30) Foreign Application Priority Data

Jun. 1, 2001 (CH) ..... 1010/01

(51) Int. Cl.[7] ..... F23D 14/46; F23M 3/00

(52) U.S. Cl. ..... 431/350; 431/115; 431/116; 431/9

(58) Field of Search ..... 431/350, 351, 431/352, 353, 115, 116, 9

(56) References Cited

U.S. PATENT DOCUMENTS

| | | | | |
|---|---|---|---|---|
| 3,927,958 A | | 12/1975 | Quinn | |
| 5,584,182 A | * | 12/1996 | Althaus et al. | 60/737 |
| 5,645,410 A | * | 7/1997 | Brostmeyer | 431/10 |
| 5,655,903 A | * | 8/1997 | Fischer | 431/353 |
| 5,674,066 A | * | 10/1997 | Hausermann et al. | 431/173 |
| 5,833,451 A | * | 11/1998 | McMillan | 431/350 |
| 5,921,766 A | * | 7/1999 | Dobbeling et al. | 431/173 |
| 5,954,490 A | * | 9/1999 | Knopfel et al. | 431/115 |
| 6,019,596 A | * | 2/2000 | Knopfel et al. | 431/350 |
| 6,059,565 A | * | 5/2000 | Knopfel et al. | 431/350 |
| 6,102,692 A | * | 8/2000 | Dobbeling et al. | 431/350 |
| 6,196,835 B1 | * | 3/2001 | Gutmark et al. | 431/350 |
| 6,331,109 B1 | * | 12/2001 | Paikert et al. | 431/350 |

FOREIGN PATENT DOCUMENTS

| | | |
|---|---|---|
| DE | 44 11 624 | 10/1997 |
| DE | 19640198 A1 | 4/1998 |
| EP | 0210462 A1 | 2/1987 |
| EP | 0 394 800 | 10/1990 |
| EP | 0321809 B1 | 5/1991 |
| EP | 0433790 B1 | 6/1991 |
| EP | 0436113 A1 | 7/1991 |
| EP | 0629817 A2 | 12/1994 |
| EP | 0690263 A2 | 1/1996 |
| EP | 0780629 A2 | 6/1997 |
| EP | 0 780 630 | 6/1997 |
| EP | 0833105 A2 | 4/1998 |
| EP | 0866267 A1 | 9/1998 |

* cited by examiner

*Primary Examiner*—Alfred Basichas
(74) *Attorney, Agent, or Firm*—Burns, Doane, Swecker & Mathis, L.L.P.

(57) ABSTRACT

In a premixing burner (1) for a gas turbine or hot-gas generation for the combustion of liquid or gaseous fuel, in which fuel is mixed with combustion air (9*a*, 9*b*) in a burner interior (14), is fed to a combustion chamber (3) and is burnt in this combustion chamber (3), stabilization in the part-load model is achieved in a simple and efficient way in that means (15) are provided which make it possible to recirculate hot exhaust gas (17) out of the combustion chamber (3) into the burner interior (14) and to stabilize the flame by means of selfignition processes. The means (15) are preferably a recirculation line which picks up hot exhaust gas (17) from the outer backflow zone (10) and feeds it to the burner interior (14) in the region of a burner tip (2) facing away from the combustion chamber (3), additional fuel (pilot fuel 21) being admixed with the exhaust gas (17) in the recirculation line upstream of the feed to the burner interior (14).

21 Claims, 5 Drawing Sheets

BURNER WITH EXHAUST GAS RECIRCULATION

This application claims priority under 35 U.S.C. §§ 119 and/or 365 to Appln. No. 2001 1010/01 filed in Switzerland on Jun. 1, 2001; the entire content of which is hereby incorporated by reference.

FIELD OF THE INVENTION

The present invention relates to a burner for a gas turbine or hot-gas generation for the combustion of liquid or gaseous fuel and to a method for operating it.

BACKGROUND OF THE INVENTION

A principal problem which has to be solved within the framework of the development of industrial premixing burners for use in gas turbines or for hot-gas generation is the stabilization of the flame primarily in the part-load operating mode. Most industrial burners of this type utilize a swirl flow for generating a backflow zone on the burner axis. In these burners, flame stabilization takes place aerodynamically, that is to say without special flame holders. In this case, the backflow zones, which occur during the breakdown of the vortex, or the outer recirculation zones are utilized. Hot exhaust gases from these zones in this case ignite the fresh fuel/air mixture.

A burner according to the prior art, in which, for example, a backflow zone of this type is formed on the axis of the burner, is described in EP 0 210 462 A1. In the dual burner, specified there, for a gas turbine, the swirl body is formed from at least two double-curved metal plates acted upon by tangential air inflow, the plates being folded so as to be widened outward in the outflow direction. During outflow into the combustion chamber, a backflow zone at the downstream end of the inner cone is formed on the axis of the burner as a result of the increasing swirl coefficient in the flow direction. The geometry of the burner is in this case selected such that the vortex flow at the center has low swirl and axial velocity excess. The increase in the swirl coefficient in the axial direction then leads to the vortex backflow zone remaining in a stable position.

Further examples of what are known as double-cone burners are found in the prior art in EP 0 321 809 B1 and in EP 0 433 790 B1. In these burners with a conical shape opening in the flow direction, in which there are two part-cone bodies which are positioned one on the other and the center axes of which run, offset to one another, in the longitudinal direction, combustion air flows through the tangential inflow slots formed as a result of the offset into the interior of the burner. Simultaneously, during inflow through these slots, fuel is admixed with the combustion air, with the result that a conical fuel/combustion-air cone is formed and, again, a backflow zone in a stable position is formed in the region of the burner mouth.

In burners of this type, a power output reduction is achieved principally by a reduction in the fuel mass flow, with the air mass flow remaining approximately constant. That is to say, in other words, that, with a decreasing power output, the fuel/air mixture becomes increasingly leaner. However, since modern premixing burners are already operated near the lean extinguishing limit for the purpose of NOx minimization, other combustion concepts have to be developed for the part-load operating mode, in order to prevent extinguishing or an unstable behavior in the case of an increasingly leaner fuel/air mixture.

The prior art discloses, as combustion concepts for the part-load operating mode, for example, what is known as burner staging, in which individual burners are switched off in a specific manner, so that the remaining burners can be operated under full load. Particularly in the case of annular combustion chambers with a plurality of mutually offset burner rings having a different radius, this concept can be employed with a certain amount of success.

On the other hand, the transition from premixing combustion to diffusion-flame-like combustion is proposed, which, as is known, has a lower extinguishing limit in relation to the temperature. Consequently, a double operation of individual burners, which is employed according to the load, to be precise a premix-like and a diffusion-like operation, is proposed, in order to prevent extinguishing in the part-load mode. The problem with this, however, is that, on the one hand, it is complicated to design a burner for two different operating modes and, on the other hand, diffusion-like combustion usually cannot be carried out optimally in terms of emissions.

EP 0 866 267 A1 discloses the mixing of fresh air with recirculated smoke gas in the mirror-symmetrically tangentially arranged feed ducts of a double-cone burner in the case of atmospheric combustion. The combustion air enriched with the recirculated exhaust gas gives rise, for example, to better evaporation of the liquid fuel fed, via a central fuel nozzle, within the premixing zone induced by the length of the premixing burner. Although a lowering of pollutant emissions can consequently advantageously be achieved, nevertheless one disadvantage in a stabilization of the burner during the starting phase is that it is necessary to have a blow-off device which is connected operatively to the air plenum and by the use of which the admission pressure in the plenum is lowered, the air mass flow through the burner is reduced and consequently the air ratio is decreased.

SUMMARY OF THE INVENTION

The object of the invention is, therefore, to make available a burner for a gas turbine or hot-gas generation for the combustion of liquid or gaseous fuel, in which burner fuel is mixed with combustion air in a burner interior, is fed to a combustion chamber and is burnt in this combustion chamber, and a method for operating a burner of this type, which makes it possible to have a stable part-load operating mode.

As already mentioned above, double-cone burners from the prior art cannot achieve the abovementioned object, since, because operation is already lean in the full-load mode, in the part-load mode the flame becomes unstable or is even extinguished.

The present invention achieves the object by the provision of means which can stabilize the flame in the part-load mode.

The subject of the invention is consequently a burner of the abovementioned type, in which means are provided which make it possible to recirculate hot exhaust gas out of the combustion chamber into the burner interior for stabilization in the part-load mode.

The essence of the invention is, therefore, that the hot exhaust gases from the combustion chamber are used to stabilize the flow behavior in the burner interior and near the burner mouth, particularly in the part-load mode, that is to say during lean operation with reduced power output. Such recirculation of exhaust gases makes it possible to use burners of this type in machines (in particular, machines with variable inlet guide vane assemblies, VIGV) in a load range 30–100%.

According to a first preferred embodiment of the invention, the means are a recirculation line which, furthermore, picks up preferably hot exhaust gas on an axial combustion chamber wall near outer backflow zones present next to the burner mouth issuing into the combustion chamber and which feeds it to the burner interior in the region of a burner tip facing away from the combustion chamber. In such recirculation of the hot exhaust gases from a backflow zone, this recirculation takes place usually passively, that is to say the flow of hot exhaust gas into the burner interior does not have to be driven.

Another embodiment of the invention is distinguished in that the burner has at least one inner backflow zone. In a burner of this type, the result of the recirculation of the hot exhaust gases is that precisely this inner central backflow zone is stabilized on the axis of the burner by these hot exhaust gases.

In a further embodiment of the invention, the burner is a double-cone burner with at least two part-cone bodies positioned one on the other and having a conical shape opening toward the combustion chamber in the flow direction, the center axes of these part-cone bodies running, offset to one another in the longitudinal direction, in such a way that tangential inflow slots into the burner interior are formed over the length of the burner, through which inflow slots combustion air flows in, fuel being injected at the same time into the burner interior, so as to form a conical swirling fuel column and, subsequently, the mixture flows out, so as to form an inner backflow zone, into the combustion chamber and is burnt there. Particularly in the case of a double-cone burner of this type, the stabilization of the backflow zone on the burner axis can commence efficiently. In this case, the inner central backflow zone is stabilized particularly effectively when the hot exhaust gas is fed to the burner interior centrally in the vortex core, that is to say essentially on the burner axis, and, moreover, preferably as near as possible to the burner tip, that is to say at the point of the double-cone burner with the smallest diameter. The recirculation of the hot exhaust gases may in this case even take place actively in such a way that, in particular in the part-load mode, an inner backflow zone is completely or partially prevented.

According to a further embodiment of the invention, moreover, means are provided which make it possible to admix fuel with the hot recirculated exhaust gas. In combination with the increased temperature of the hot exhaust gases, this admixing of fuel leads to a selfigniting mixture being fed to the burner interior. Preferably, furthermore, fuel injection, exhaust-gas temperature and flow velocity are coordinated with one another in such a way that selfignition of the fuel takes place in the combustion chamber.

According to another preferred embodiment of the invention, not only fuel, but additionally also pilot air, is admixed with the recirculated hot exhaust-gas air. The admixing of the pilot air may in this case take place on the injection principle, that is to say in a way which drives the exhaust-gas air stream. By the additional introduction of pilot air into the exhaust-gas air duct, the burner can be actively regulated optimally in the part-load mode, using only a little additional air. To be precise, the usually cold pilot air may, on the one hand, be used for setting the temperature of the recirculated exhaust-gas air, but, on the other hand, the pilot air may also be utilized for increasing or lowering the exhaust-gas air stream, that is to say the flow velocity. Consequently, with the aid of the pilot air, selfignition, that is to say, in particular, the selfignition location of the mixture of hot exhaust gas and the fuel in or upstream of the burner interior in the combustion chamber, can be set exactly, that is to say optimized in terms of the influence exerted on the backflow zones.

The present invention relates, furthermore, to a method for operating a burner, such as is described above. Thus, in particular, exhaust gas recirculation is cut in and cut out as a function of the instantaneous power output stage of the burner, and, in particular, preferably the recirculation of hot exhaust gas is employed in the part-load mode. According to a preferred embodiment of the method mentioned, in this case the pilot-air stream is used for controlling the formation of the inner backflow zone or else also in order to block the recirculation of the exhaust-gas air, so that the swirl of the main airflow is sufficient to cause a breakdown of the vortex.

Further preferred embodiments of the burner and of the method are described in the dependent patent claims.

BRIEF DESCRIPTION OF THE DRAWINGS

The invention will be explained in more detail below with reference to exemplary embodiments, in conjunction with the drawings, in which.

DETAILED DESCRIPTION OF THE INVENTION

Figure 1:
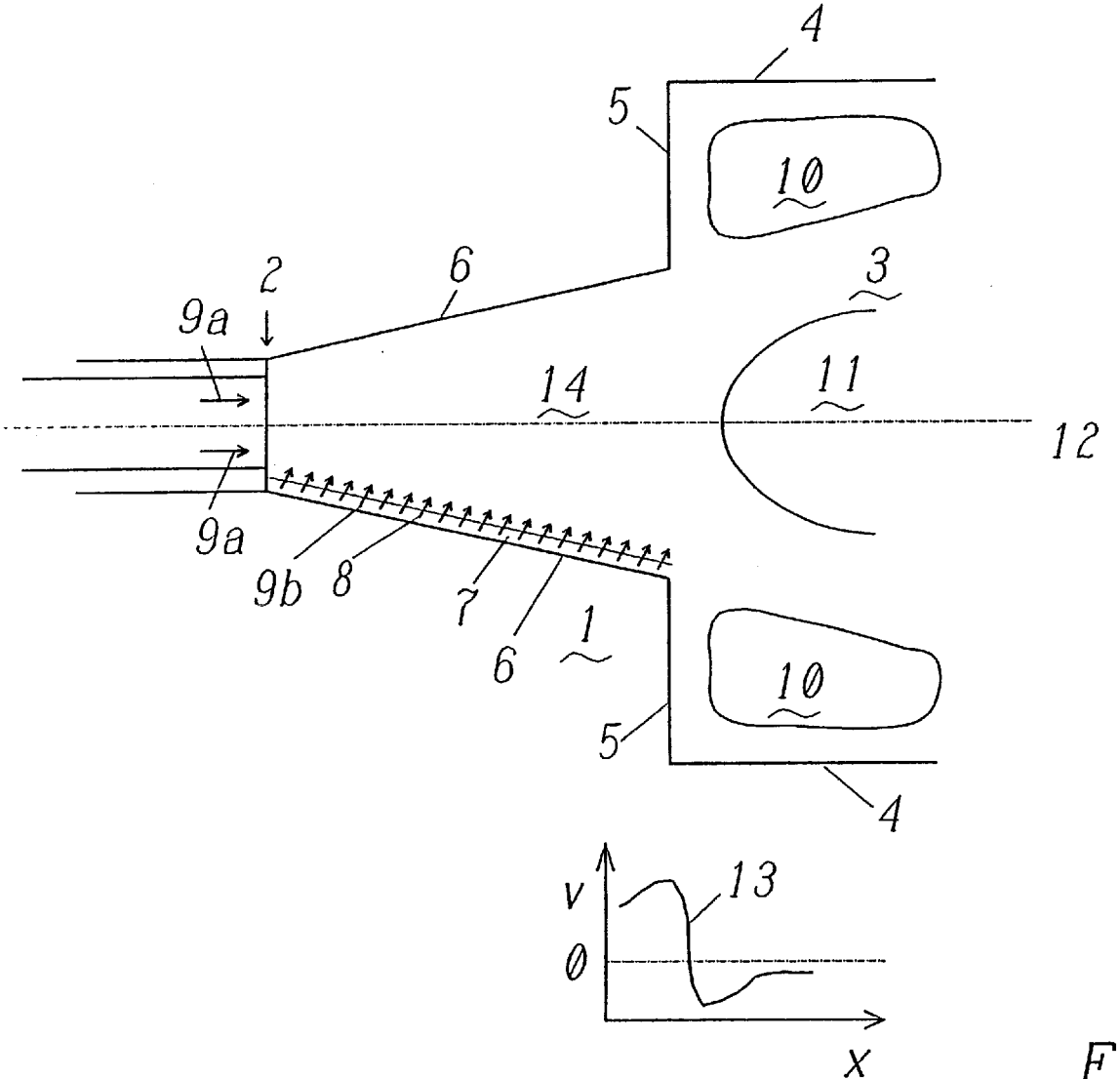
FIG. 1 shows a double-cone burner in axial section and the backflow zones occurring during operation.

FIG. 1 shows a double-cone burner 1, formed from two part-cone bodies 6, the axes of which are offset relative to one another in such a way that a slot 7 is formed between the part-cone bodies 6. Combustion air 9*b* flows tangentially through this slot 7 into the burner interior 14. Moreover, axial combustion air 9*a* is supplied to the burner interior 14 from the side of the burner tip 2 where the diameter of the burner is at a minimum. Fuel 8 is admixed with the tangential combustion air 9*b*, so that a conical swirling cone consisting of a fuel/air mixture is formed in the burner interior 14. In addition to the admixing of fuel near the slot 7 between the part-cone bodies 6, in particular, liquid fuel can also be supplied to the burner interior 14 axially, that is to say near the burner tip 2, via a central nozzle.

During the outflow of this cone into the combustion chamber 3, various backflow zones are formed at the same time. On one side, what are known as outer backflow zones 10 are formed laterally next to the burner mouth, these backflow zones being delimited, on the one hand, by the axial combustion chamber wall 5, and, on the other hand, by the radial combustion chamber wall 4. The radial combustion chamber wall 4 does not in this case necessarily have to be present, however, since a plurality of burners 1 may also be arranged next to one another. Moreover, an inner backflow zone 11, which occurs during the breakdown of the vortex, is formed on the burner axis 12 as a result of the swirl coefficient which increases in the direction of the combustion chamber.

FIG. 1 also illustrates a graph which represents the axial velocity distribution 13 as a function of the x-coordinate along the burner axis 12 in the region of the inner backflow zone 11. It can be seen from this that, at a specific point upstream of the burner mouth, the axial velocity of the gas passes through the zero point and becomes negative, that is to say exactly the backflow zone 11 occurs. The burner according to FIG. 1 is a burner such as is described, for example, in European patent applications EP 0 321 809 B1 and EP 0 433 790 B1.

Figure 2:
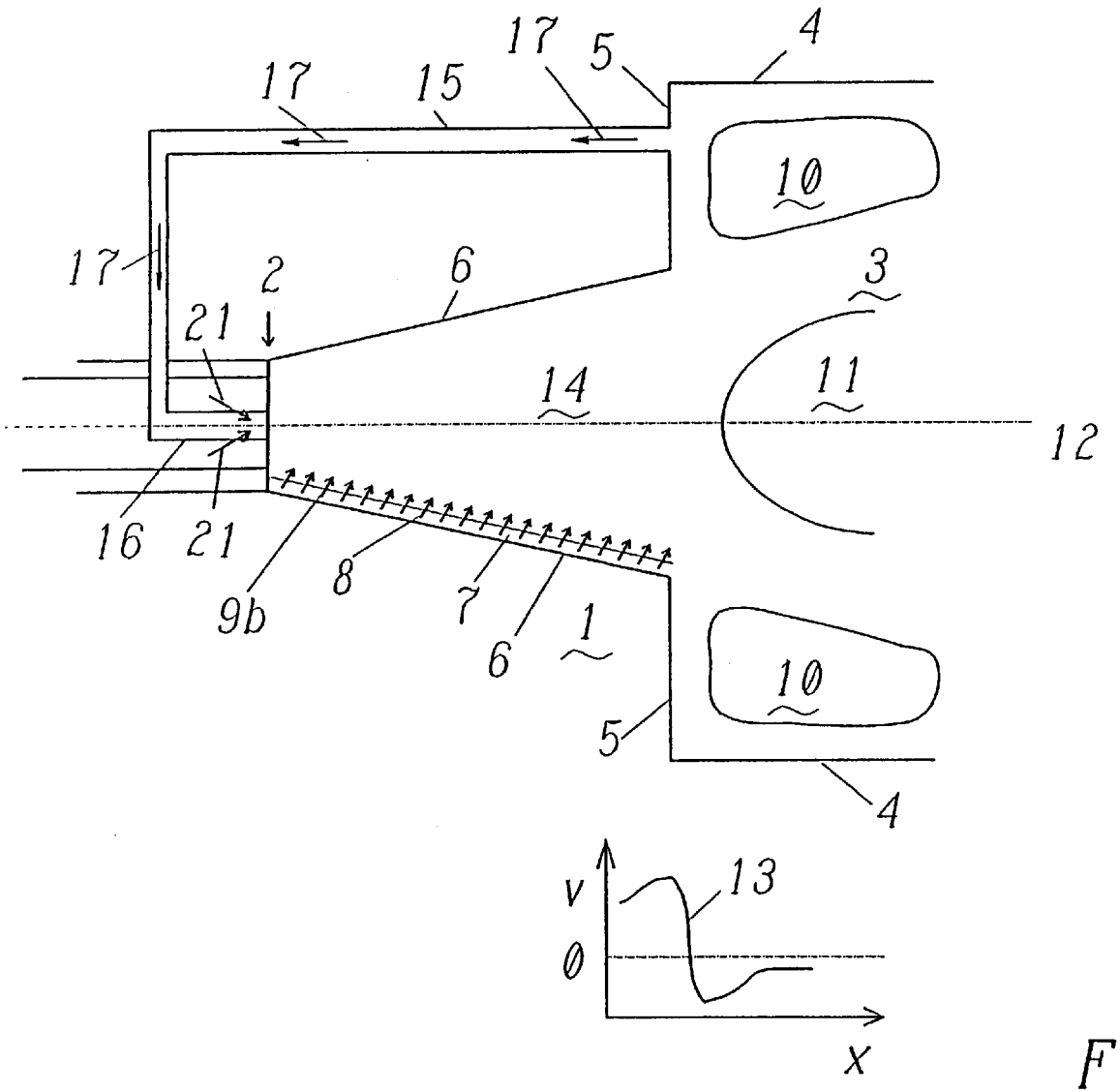
FIG. 2 shows a double-cone burner according to FIG. 1 with exhaust gas recirculation.

FIG. 2, then, shows how, according to the invention, hot exhaust gas 17 is fed out of the combustion chamber 3, particularly preferably out of the outer backflow zones 10, along the axial combustion chamber wall 5, via a recirculation line 15, to the burner interior 14. The central injection portion 16 of the recirculation line 15 is in this case advantageously arranged on the burner axis 12, so that the hot exhaust gas 17 is injected in the vortex core of the conical fuel/combustion-air cone formed in the burner interior 14. Optimum stabilization of the inner recirculation zone 11 is thereby brought about. The flow of recirculated exhaust gas in this case moves typically within the range of 2–10%.

Figure 3:
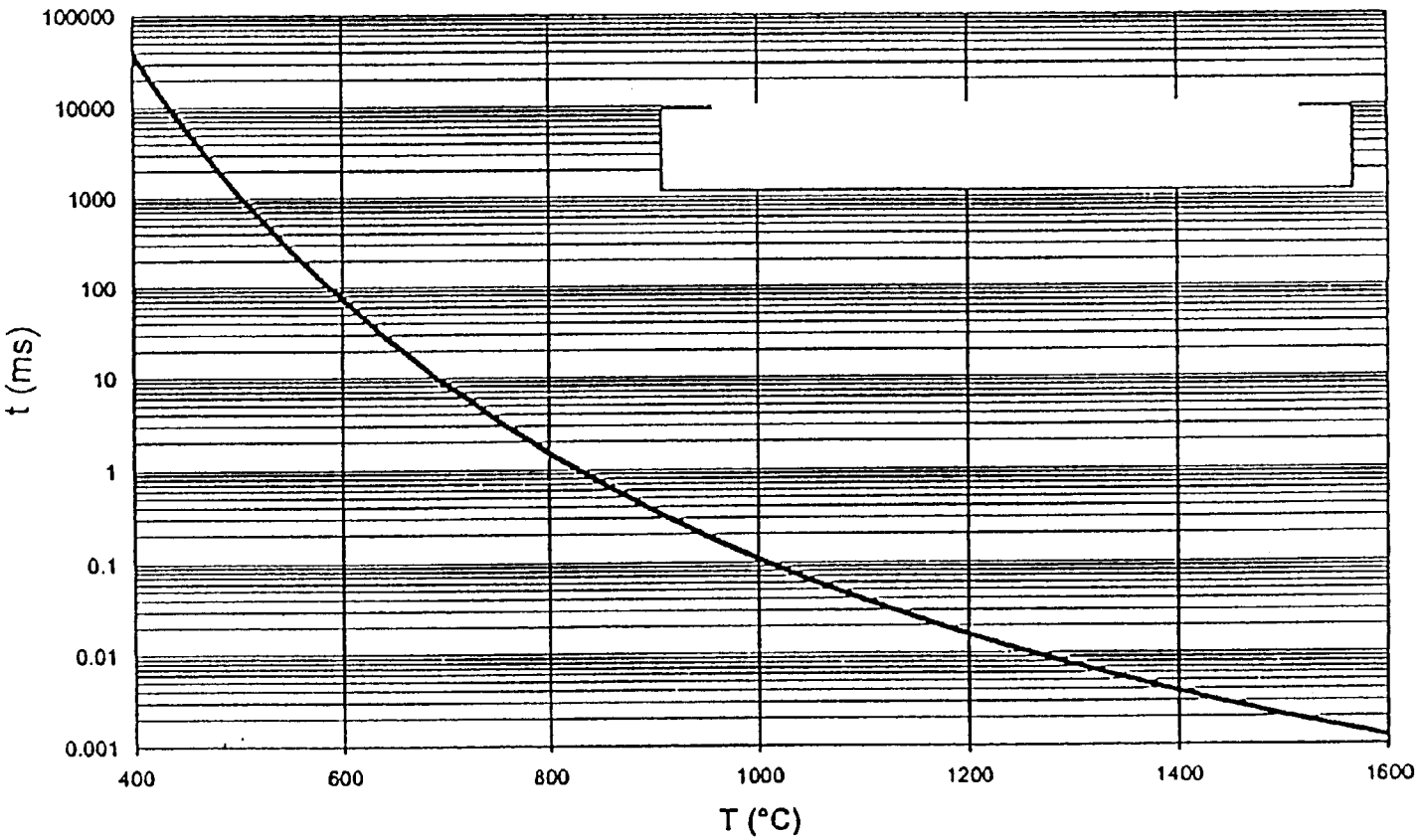
FIG. 3 shows the selfignition time of a fuel/air mixture as a function of the temperature.

If the recirculated exhaust gas 17 is additionally mixed with fuel (pilot fuel 21), a selfigniting mixture can be formed, depending on the exhaust-gas temperature T, the fuel concentration and the dwell time. FIG. 3, in this respect, shows the selfignition time in ms of a fuel/air mixture at a pressure of 15 bar, in the case of 1=2.7, and with an oxygen content of 15 percent, as a function of the temperature in degrees Celsius.

In a double-cone burner 1 as described above (for example, a burner of the type EV 17 of the applicant), nominal velocities of 30 m/s typically occur, dwell times of 2 to 7 ms being obtained. In other words, at the typical temperatures of the recirculated hot exhaust gases 17 of 700 to 800 degrees Celsius, such short selfignition times are obtained that selfignition occurs before the mixture leaves the burner.

Figure 4:
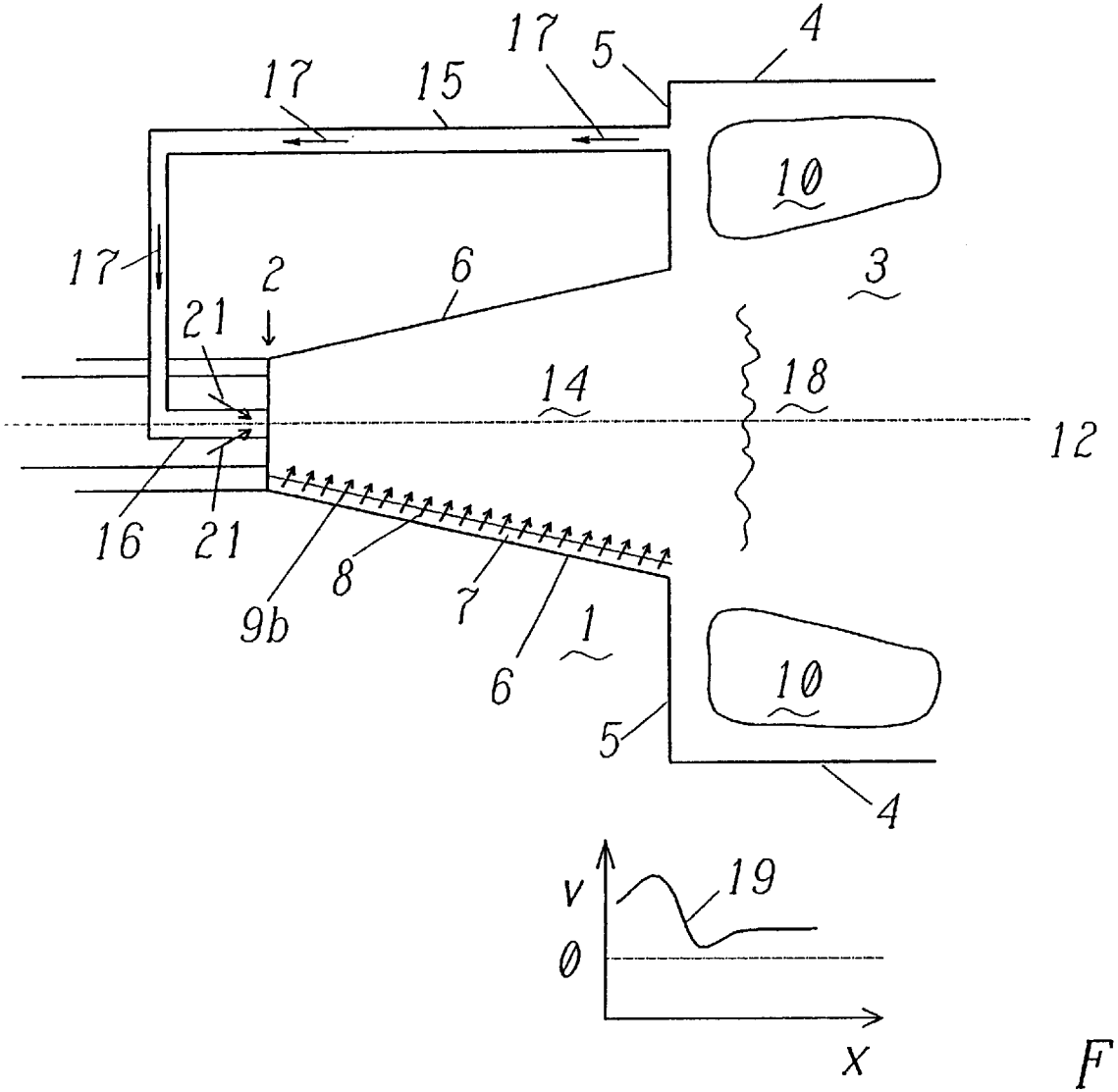
FIG. 4 shows a double-cone burner according to FIG. 2, in which the central backflow zone is prevented.

FIG. 4, then, shows a section through a double-cone burner, in which the recirculated hot exhaust gas 17 influences the vortex core to such an extent that an inner backflow zone 11 can no longer be formed. This pronounced exertion of influence may take place in that either a large flow of hot exhaust gas 17 is injected into the vortex core or, in particular, in that additional fuel 21 is admixed with the hot exhaust gas 17. This is, as it were, a burner with active exhaust gas recirculation. Again, approximately 2–10% of the exhaust gas is recirculated. In order to position the selfignition location of the mixture of hot exhaust gas 17 and fuel in the right place in the vortex core, that is to say in order to prevent a backflow zone, in particular for the part-load mode, the flow velocity and the exhaust-gas temperature must be coordinated exactly with one another. If the backflow zone is prevented in the region of the zone 18, an axial velocity distribution 19, such as is illustrated in the lower part of FIG. 4, is established. The velocity of the air stream flowing on the burner axis 12 still experiences a reduction in velocity v in the zone 18, but there is no longer any zero passage, and no negative velocities occur, that is to say a backflow zone is absent.

Figure 5:
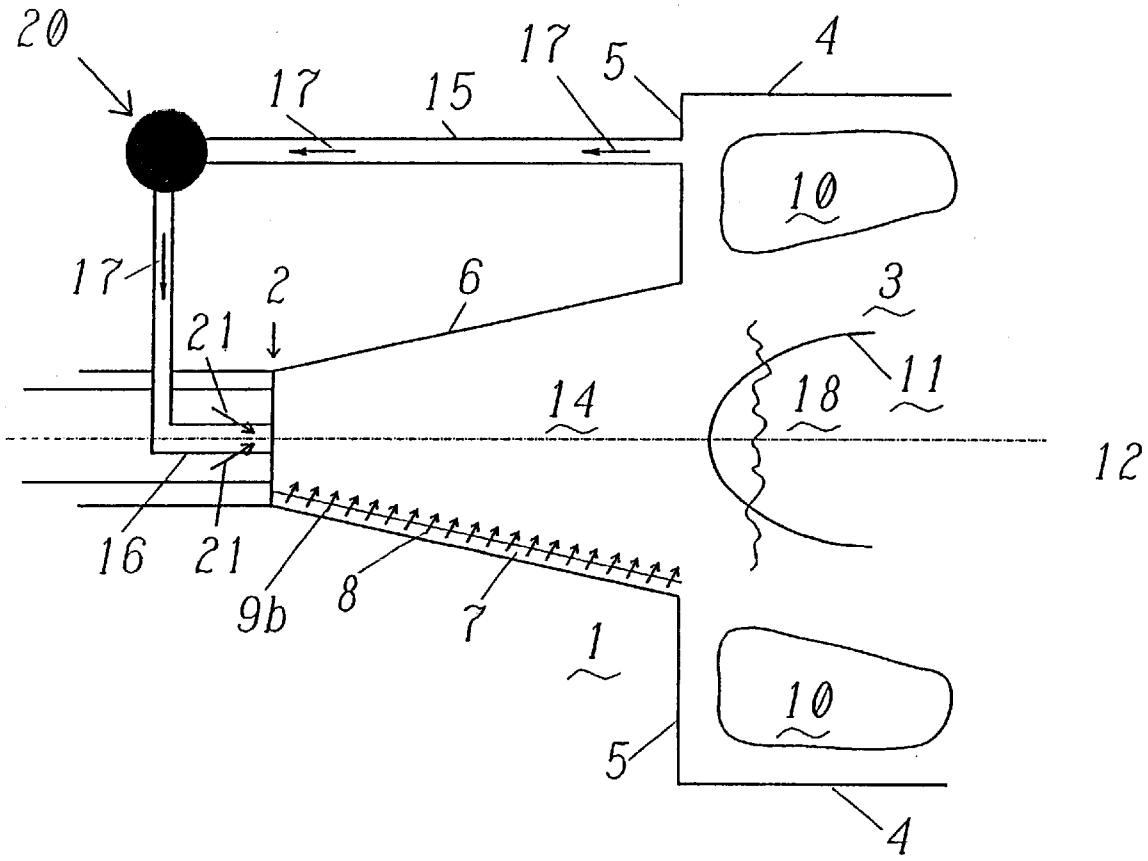
FIG. 5 shows a double-cone burner according to FIG. 4, in which pilot air can be supplied in addition to the hot recirculated exhaust-gas air.

FIG. 5 illustrates a further exemplary embodiment, in which not only is additional fuel 21 admixed with the hot exhaust gases 17, but, in addition, pilot air 20 is used for controlling the hot exhaust-gas stream 17. The pilot air 20 may, in principle, be admixed with the hot exhaust gas 17 at any desired point in the recirculation line 15. Preferably, however, for the sufficient mixing of pilot air and exhaust-gas air, injection takes place at least 10 pipe diameters upstream of the injection point. The routing of the pilot air 20 may in this case advantageously be organized on the injector principle, that is to say in such a way that the flow velocity of the hot exhaust gases 17 can be driven by the pilot air 20. Alternatively, the routing of the pilot air 20 may be designed in such a way that the recirculated exhaust-gas stream 17 can be blocked, and the swirl of the main airflow is sufficient to cause a breakdown of the vortex. If, in this arrangement, the pilot air 20 is cut off, stabilization takes place again via the selfignition process.

The pilot-air stream 20 makes it possible, using comparatively little additional air, on the one hand, to set the temperature of the recirculated exhaust gas 17 and consequently the selfignition time and also to control the formation of the inner recirculation zone. Typically, less than 10% of the total burner air is supplied via recirculation (pilot air and exhaust-gas air).

The recirculation of hot exhaust gas into the burner interior for stabilization in the part-load mode may also be employed in other burners, for example in burners of the type AEV of the applicant, in which a mixing zone in the form of a pipe is arranged downstream of the swirl generator in the form of the double cone (cf., for example, EP 0 780 629 A2). These burners consist, in general terms, of a swirl generator for a combustion-air stream, which swirl generator may take the form of a double cone or else the form of an axial or radial swirl generator, and of means for injecting a fuel into the combustion-air stream. Moreover, they are characterized in that, downstream of the swirl generator, a mixing zone is arranged, which has, within a first zone part, transitional ducts, running in the flow direction, for transferring a flow formed in the swirl generator into a pipe located downstream of the transitional ducts, the outflow plane of this pipe into the combustion chamber being designed with a breakaway edge for stabilizing and enlarging a backflow zone which is formed downstream. In these burners, too, a stable inner and outer backflow zone is formed downstream of the breakaway edge in the combustion chamber.

The recirculation of the hot exhaust gases for stabilization in the part-load mode takes place, here too, out of the combustion chamber, in particular preferably so as to be picked up next to the burner mouth, via a recirculation line which injects the hot exhaust gases, if appropriate with the admixing of pilot air and/or fuel, preferably axially centrally into the burner tip, that is to say, in this case, into the center of that end of the swirl generator which faces away from the combustion chamber.

The novel method for exhaust gas recirculation may also be employed in a burner such as is described, for example, in DE 19640198 A1. In a burner of this type, the swirl generator arranged upstream of the mixing pipes configured cylindrically, but, in its interior, has a conical inner body running in the flow direction. The outer casing of the interior is pierced by tangentially arranged air inflow ducts, through which a combustion-air stream flows into the interior. The fuel is in this case injected via a central fuel nozzle arranged at the tip of the inner body. In a burner of this type, too, a stable inner and outer backflow zone are formed downstream of the breakaway edge in the combustion chamber.

Here, too, for stabilization in the part-load mode, the recirculation of the hot exhaust gases takes place out of the combustion chamber, again preferably so as to be picked up next to the burner mouth, via a recirculation line which injects the hot exhaust gases, if appropriate with the admixing of pilot air and/or fuel, preferably axially centrally. Axially centrally means, in this case, that injection preferably takes place near the tip of the inner body tapering in the flow direction, into the swirl center, that is to say in the region of fuel injection.

LIST OF DESIGNATIONS

1 double-cone burner
2 burner tip
3 combustion chamber
4 combustion chamber wall (radial)
5 combustion chamber wall (axial)
6 part-cone body
7 inflow slot between part-cone bodies
8 fuel injected at the gap
9*a* axially inflowing combustion-air stream
9*b* tangentially inflowing combustion-air stream
10 outer recirculation zone
11 Iinner recirculation zone
12 burner axis
13 velocity distribution in the axial direction
14 burner interior
15 recirculation line
16 central injection portion
17 recirculated hot exhaust gas
18 zone with exhaust gas recirculation and selfignition
19 axial velocity distribution
20 pilot air
21 additional fuel (pilot fuel)
v axial velocity
x axial direction
t selfignition time
T gas temperature

What is claimed is:

1. A premixing burner for a gas turbine or hot-gas generation for the combustion of liquid or gaseous fuel, in which fuel is mixed with combustion air in a burner interior, is fed to a combustion chamber and is burnt in this combustion chamber, wherein means are provided which make it possible to recirculate hot exhaust gas out of the combustion chamber into the burner interior for stabilization in the part-load mode, and wherein the means are a recirculation line which picks up hot exhaust gas on an axial combustion chamber wall near outer backflow zones present next to the burner mouth issuing into the combustion chamber and which feeds the hot exhaust gas to the burner interior in the region of the burner tip facing away from the combustion chamber.

2. The burner as claimed in claim 1, wherein the burner has an inner backflow zone.

3. The burner as claimed in claim 1, wherein it is a burner without an additional premixing zone.

4. The burner as claimed in claim 1, wherein the burner is a double-cone burner with at least two part-cone bodies positioned one on the other and having a conical shape opening toward the combustion chamber in the flow direction, the center axes of these part-cone bodies running, offset to one another in the longitudinal direction, in such a way that tangential inflow slots into the burner interior are formed over the length of the burner, through which inflow slots combustion air flows in, fuel being injected at the same time into the burner interior, so as to form a conical swirling fuel column, and, subsequently, the mixture flows out, so as to form an inner backflow zone, into the combustion chamber and is burnt there.

5. The burner as claimed in claim 4, wherein, in addition, fuel is injected centrally, near the burner tip, on the tapered side of the part-cone bodies which faces away from the combustion chamber.

6. The burner as claimed in claim 1, consisting of a swirl generator for a combustion-air stream and of means for injecting a fuel into the combustion-air stream, which burner has, downstream of the swirl generator, a mixing zone, which has, within a first zone part, transitional ducts, running in the flow direction, for transferring a flow formed in the swirl generator into a pipe located downstream of the transitional ducts, the outflow plane of this pipe into the combustion chamber being designed with a breakaway edge for stabilizing and enlarging a backflow zone formed downstream.

7. The burner as claimed in claim 6, wherein the swirl generator is in the form of a double cone.

8. The burner as claimed in claim 7, wherein the swirl generator is configured cylindrically and, in its interior, has a conical inner body running in the flow direction, the outer casing of the interior being pierced by tangentially arranged air inflow ducts, through which a combustion-air stream flows into the interior, and fuel being injected via a central fuel nozzle arranged at the tip of the inner body.

9. The burner as claimed in claim 1, wherein the hot exhaust gas is supplied to the burner interior centrally in the vortex core, essentially on the burner axis.

10. The burner as claimed in claim 9, wherein recirculation in the part-load mode, leads to a stabilization of the inner backflow zone.

11. The burner as claimed in claim 9, wherein recirculation in the part-load mode, leads to prevention of the inner backflow zone.

12. The burner as claimed in claim 1, wherein second means are provided which make it possible to admix additional fuel to the hot recirculated exhaust gas.

13. The burner as claimed in claim 12, wherein fuel injection, exhaust-gas temperature and flow velocity can be coordinated with one another in such a way that selfignition of the fuel occurs in the combustion chamber.

14. The burner as claimed in claim 13, wherein pilot air can be admixed with hot exhaust gas.

15. The burner as claimed in claim 14, wherein pilot air can be admixed with hot exhaust gas, and wherein this admixing takes place based on the injection principle.

16. The burner as claimed in claim 15, wherein the admixing of pilot air can be utilized for setting the optimum with regard to fuel injection, exhaust-gas temperature, flow velocity and, consequently, the selfignition location in the combustion chamber.

17. A method for operating a burner as claimed in claim 1, wherein exhaust gas recirculation is cut in and cut out, depending on the instantaneous power output stage of the burner.

18. The method as claimed in claim 17, wherein the pilot-air stream is used for controlling the formation of the inner recirculation zone.

19. The method as claimed in claim 18, wherein the pilot air can be used for blocking the exhaust-gas air, so that the swirl of the main airflow is sufficient to cause a breakdown of the vortex.

20. A method for operating a burner as claimed in claim 1, the recirculation of hot exhaust gas is employed in the part-load mode.

21. The burner as claimed in claim 1, wherein there are no additional premixing zones other than the premixing that occurs within the burner.

* * * * *